US008857728B2

(12) United States Patent
Foan

(10) Patent No.: US 8,857,728 B2
(45) Date of Patent: Oct. 14, 2014

(54) RAIL SUPPORT ARRANGEMENT

(75) Inventor: Andrew Raymond Foan, Nuthall (GB)

(73) Assignee: Progress Rail Services Corp, Albertville, AL (US)

( * ) Notice: Subject to any disclaimer, the term of this patent is extended or adjusted under 35 U.S.C. 154(b) by 156 days.

(21) Appl. No.: 13/432,695

(22) Filed: Mar. 28, 2012

(65) Prior Publication Data

US 2012/0248216 A1 Oct. 4, 2012

(30) Foreign Application Priority Data

Mar. 28, 2011 (GB) ..... 1105170.3
Mar. 30, 2011 (GB) ..... 1105354.3

(51) Int. Cl.
*E01B 2/00* (2006.01)
*E01D 19/12* (2006.01)

(52) U.S. Cl.
CPC ..... *E01D 19/12* (2013.01); *E01B 2/003* (2013.01)
USPC ..... 238/281; 238/264

(58) Field of Classification Search
CPC ..... E01D 19/12; E01D 2/003
USPC ..... 104/130.05, 101; 238/24, 26, 19, 109, 238/264, 281, 287; 14/73.5, 73.1
See application file for complete search history.

(56) References Cited

U.S. PATENT DOCUMENTS 2,559,375 A * 7/1951 Schaffan, Jr. ..... 238/10 R
6,695,219 B1 * 2/2004 Fowler et al. ..... 238/10 B

FOREIGN PATENT DOCUMENTS

DE 19825270 A 12/1998
DE 19806566 A 4/2007

* cited by examiner

*Primary Examiner* — Mark Le

(57) ABSTRACT

An arrangement for supporting a rail extending in the longitudinal direction and having curvature, which is configured to vary, in the vertical or horizontal plane. The arrangement comprises at least one support beam extending in the longitudinal direction, the support beam having a support surface extending along its length, the support surface being curved along the length of the support beam. The arrangement further comprises at least one rail extending in the longitudinal direction and supported over the support surface of the at least one support beam.

19 Claims, 4 Drawing Sheets

RAIL SUPPORT ARRANGEMENT

TECHNICAL FIELD

This invention relates to an arrangement for supporting a longitudinal rail, such as a railway rail, having curvature in the vertical or horizontal plane which is configured to vary over time. Such an arrangement may be employed in a railway bridge joint, for example.

BACKGROUND OF THE INVENTION

There are numerous circumstances in which longitudinal rails and their supports need to be tolerant of varying degrees of curvature in the vertical or horizontal plane. Herein, references to curvature in the vertical or horizontal plane are to curvature along the length of a rail.

A common circumstance in which there is such curvature of a rail is in a railway bridge joint. In a typical railway bridge joint, the rails on either side of the joint are rigidly attached to supports but a degree of relative rotational movement between the supports is permitted over time, for example as a consequence of thermal expansion and contraction of the bridge structure. Relative rotational movement between the supports may, for example, amount to 2.5 degrees or more of angular misalignment. This misalignment between the supports necessitates curvature in the portions of the rails which are arranged between the supports.

A number of support arrangements for rails having curvature in the vertical plane are known. A known support arrangement comprises a plurality of hinged support elements which serve to divide an angle between the end supports into smaller segments to reduce the impact at the end of each segment. Other known arrangements involve the provision of sprung and/or damped supports along the rail which allow the rail to bend while resisting large deflections caused by railway vehicle loads.

A problem associated with the known arrangements for supporting rails having curvature in the vertical plane is that none provides a rail having smooth curvature in the vertical plane and an appropriate level of compliance under different loadings. Embodiments of the invention seek to reduce or alleviate this problem. Embodiments of the invention may also address a corresponding problem associated with arrangements for supporting rails having curvature in the horizontal plane, such as may be used for directional control of vehicles.

SUMMARY

According to the invention, there is provided an arrangement for supporting a rail extending in the longitudinal direction and having curvature in the vertical or horizontal plane which is configured to vary, the arrangement comprising:

at least one support beam extending in the longitudinal direction, the support beam having a support surface extending along its length, the support surface being curved along the length of the support beam; and at least one rail extending in the longitudinal direction and supported over the support surface of the at least one support beam, wherein each support beam is arranged for rotation about the longitudinal direction such that the degree of curvature of the support surface, as viewed in the transverse or vertical direction, is able to vary.

The arrangement thus provides a support for a longitudinal rail, a support surface of which may vary in its degree of curvature in a smooth and continuous manner. The variation in the degree of curvature is provided by rotation of the support beam about the longitudinal direction, by which the curved surface of the beam, as viewed in either the horizontal or vertical direction, changes. According to the invention, deflection of the supported rail, for example, by a moving railway vehicle, can be resisted by the entire support beams. In particular embodiments, a spring force or damping arrangement associated with the support beams is more effective than a plurality of such arrangements spaced along the length of the rail.

The invention provides arrangements for supporting railway rails having curvature in either the vertical or horizontal plane. In the case of rails having vertical curvature, the degree of curvature of the support surface of each support beam, as viewed in the transverse direction, is able to vary by rotation of the support beam about the longitudinal direction. Such an arrangement is useful in a variety of circumstances, particularly in railway bridge joints.

In these arrangements, there may be further provided at least one transversely extending spacing element, such as a plurality of sleepers, arranged between the at least one support beam and the at least one rail. Herein, references to the transverse direction refer to the direction perpendicular to the longitudinal length and vertical height of the rails, that is to say, they refer to the side-to-side direction. The spacing elements allow for a load on the rail to be transmitted to the support beam at a plurality of, and preferably more than two, spaced apart locations. Furthermore, the spacing elements allow for a difference in the number of rails and the number of support beams; for example, two rails could be supported by three support beams using transverse sleepers therebetween.

A preferred arrangement comprises two (or more) support beams and two (or more) rails, the rails being spaced apart and in parallel arrangement. Arrangements having two support beams are particularly suitable for supporting conventional parallel railway rails. Furthermore, it is believed that arrangements having two support beams can be configured to better resist the rotational loads on sleepers at longitudinal positions where the rails and support beams are transversely spaced apart.

Each support beam may further have a mounting surface facing away from the support surface for mounting on a support structure. The mounting surface may be provided at the distal end of a limb which extends perpendicularly to the longitudinal direction. The mounting surface may be provided adjacent to the midpoint along the length of the support beam. In alternative embodiments, each supporting beam may have a substantially triangular shape, with the curved surface forming one side of the triangle and the much smaller mounting surface facing away from the curved surface and defining a vertex of the triangle shape. Other suitable shapes for the support beam will be apparent to those skilled in the art.

The mounting surface of the supporting beam may be mounted to the supporting structure in a variety of ways, but preferably such that the longitudinal position of the beam is fixed in relation to at least a part of the supporting structure. For example, the mounting surface may be received in a transversely extending channel, for example such as may be formed by a hinge line of supporting structure elements.

Optionally, each support beam may be installed such that the mounting surface is permitted to slide in the transverse direction, thereby allowing the rotation of the support beam about the longitudinal direction. At least one portion of the support surface of each support beam may then be prevented from sliding in the transverse direction, for example at its longitudinal ends. In this case, the longitudinal axis of rotation of the support beam would move transversely as the beam rotates.

Alternatively, each support beam may be installed such that portions of the support surface are permitted to slide in the transverse direction, thereby allowing the rotation of the support beam about the longitudinal direction. The mounting surface of each support beam may then be prevented from sliding in the transverse direction. Again, the longitudinal axis of rotation of the support beam would move transversely as the beam rotates.

Optionally, the support surface of each support beam may be further provided with curvature in the transverse or vertical direction (i.e. as viewed in the longitudinal direction). Such an arrangement provides a broad support in the form of a relatively large contact area for the rail or for the spacing elements. Such an arrangement also provides a smooth transition in the curvature, as viewed in the transverse or vertical direction, as the support beam rotates.

Each support beam may be adapted to rotate such that the curvature of the support surface of the beam, as viewed in the transverse or vertical direction, matches the curvature of the rail. For example, a gradually increasing angular misalignment between the ends of the rail would cause a displacement of an intermediate portion of the rail. The support beam would rotate to accommodate this displacement, thereby providing increased curvature of the support surface, as viewed in the transverse or vertical direction. The curvature of the support surface of each support beam, as viewed in the transverse or vertical direction, may define a circular arc or a parabola. In preferred embodiments, the radius of the curvature of the support surface of the support beam may be at a minimum midway along the beam in the longitudinal direction and/or at a maximum at one or both ends of the beam.

Optionally, the arrangement may comprise a spring and/or damping means for resisting the rotation of each support beam as a transient or temporary point load, such as the wheel of a railway vehicle, is applied to each rail. Suitable spring and/or damper units will be known to those skilled in the art and may provide either a torsional spring load or rotational damping of the support beam or a linear spring load or linear damping of a part of the support beam spaced from its axis of rotation.

Optionally, a range of rotation of each support beam is less then or equal to 90 degrees. However, in preferred embodiments, the range of rotation is less than 90 degrees with the support beam being arranged not to assume the completely vertical and/or horizontal positions.

Optionally, each support beam has a relatively small thickness in the direction perpendicular to the curvature, for example less than 300 mm, preferably less than 200 mm, and most preferably less than 150 mm. In this way, a significant range of curvature, as viewed in the transverse or vertical direction, can be provided with minimal space requirements beneath the at least one rail.

Another group of embodiments is arranged for supporting a rail having curvature in the horizontal plane. In these embodiments, the degree of curvature of the support surface of each support beam, as viewed in the vertical direction, is able to vary. These embodiments may, for example, be used for supporting guiding rails, as used for guiding or steering vehicles.

According to another aspect of the invention, there is provided a railway bridge having two ends and a bridging portion, wherein at least one of the ends of the bridge comprises the arrangement, for supporting a rail extending in the longitudinal direction and having curvature in the vertical plane, described above.

The railway bridge structure may provide a supporting structure for each support beam in order to provide stability to the rotation of each support beam around a longitudinal direction.

Further feature and advantages of the invention will be apparent from the following detailed description of the invention.

BRIEF DESCRIPTION OF THE DRAWINGS

Embodiments of the invention will now be described, purely by way of example, with reference to the accompanying drawings, in which.

DETAILED DESCRIPTION

The invention provides an arrangement for supporting a rail extending in the longitudinal direction and having curvature in the vertical or horizontal plane which is configured to vary. The arrangement comprises at least one support beam extending in the longitudinal direction, the support beam having a support surface extending along its length, the support surface being curved along the length of the support beam. The arrangement further comprises at least one rail extending in the longitudinal direction and supported over the support surface of the at least one support beam.

According to the invention, each support beam is arranged for rotation about a longitudinal axis such that the degree of curvature of the support surface, as viewed in the transverse or vertical direction, is able to vary.

Figure 1A:
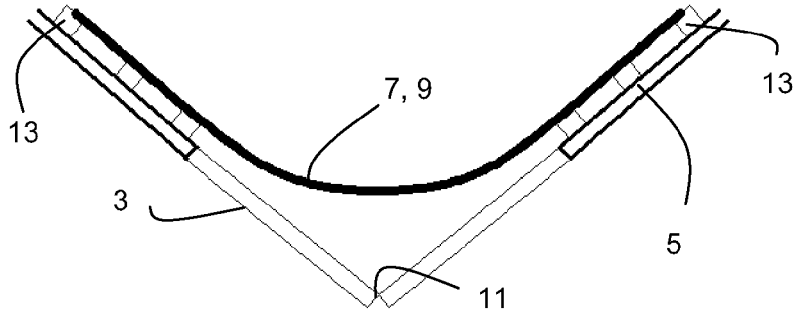
FIGS. 1*a* and 1*b* are schematic transverse side and plan views of a partially unsupported pair of rails for use in explaining the invention.
Figure 1B:
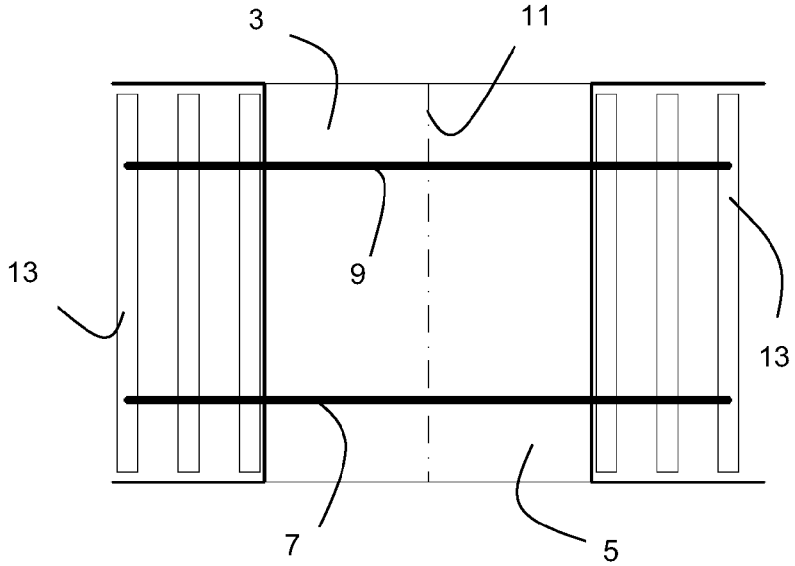

FIGS. 1*a* and 1*b* are schematic transverse side and plan views of a partially unsupported pair of rails 7, 9 for use in demonstrating a scenario in which an embodiment of the invention may be employed. It should be noted that the drawings are schematic in nature and dimensions and angles have been exaggerated for the sake of clarity. In the drawings, like reference numerals are used to denote like structure.

Referring to FIGS. 1*a* and 1*b*, there is shown a railway bridge joint comprising a pair of longitudinally adjacent support elements 3, 5 and a pair of parallel railway rails 7, 9 arranged over the support elements 3, 5.

The support elements 3, 5 form parts of the structure of a railway bridge and are pivotally coupled along a transversely extending hinge line. 11. Preferably, the support elements 3, 5 on which the rails 7, 9 are supported are rigid in construction, and may be formed of concrete, steel or other materials selected for their strength. The angular alignment between the support elements 3, 5 is configured to vary over time as a consequence of thermal expansion and movement of the railway bridge structure. Angular misalignments of 2.5 degrees or more are typical; it will be appreciated that this is greatly exaggerated in the drawings.

The railway rails 7, 9 extend in the longitudinal direction, i.e. left-to-right in the drawings. End portions of the rails 7, 9 are substantially straight and are supported on the support elements 3, 5 via transverse spacing elements in the form of sleepers 13. Between the end portions of the rails 7, 9 there are provided large spans of rail which are unsupported. The unsupported spans of rail adopt a degree of curvature in the vertical plane to accommodate the angular misalignment between the support elements 3, 5.

In known support arrangements, the portions of rail which are unsupported in FIGS. 1*a* and 1*b* may be supported by spring and/or damping arrangements provided at intervals or continuously along the rails 7, 9. However, a problem associated with such arrangements is that the rails 7, 9 are able to deflect under point loads provided by the wheels of railway vehicles. Such deflection leads to instability and material wear and fatigue. An obvious solution to this problem would be to increase the spring stiffness and/or damping along the rails 7, 9. However, there are limitations on the spring stiffness and/or damping because the rails 7, 9 must retain sufficient flexibility to adapt to changes in the angular misalignment between the support elements 3, 5.

Figure 2A:
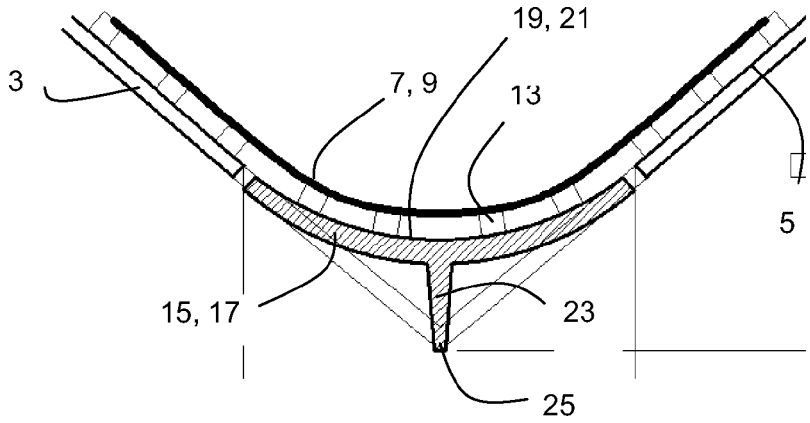
FIGS. 2*a*, 2*b* and 2*c* are schematic transverse side, plan and longitudinal end views of a rail support arrangement rail according to the invention in a first configuration.
Figure 2B:
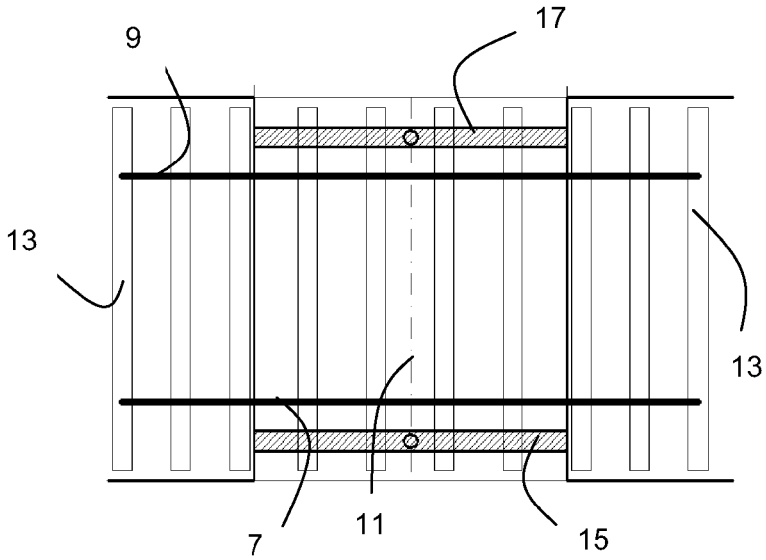
Figure 2C:
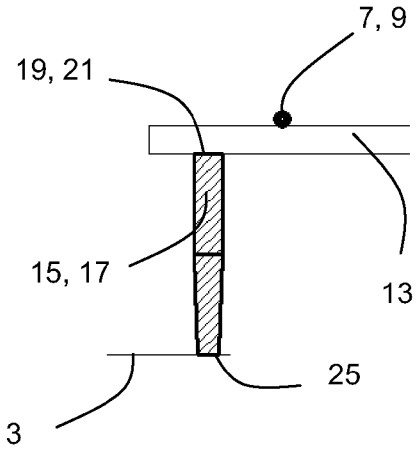
Figure 3A:
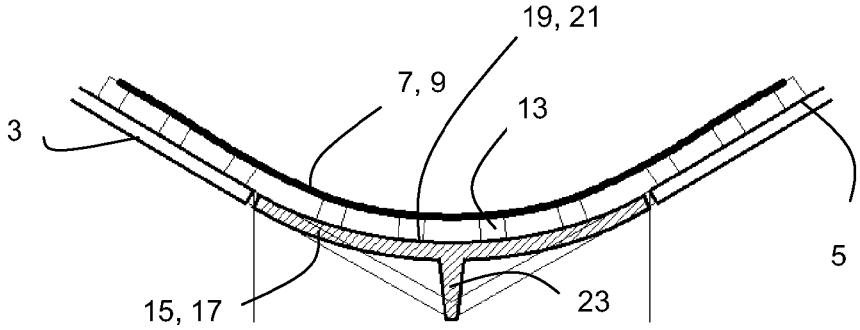
FIGS. 3*a*, 3*b* and 3*c* are schematic transverse side, plan and longitudinal end views of a rail support arrangement rail according to the invention in a second configuration.
Figure 3B:
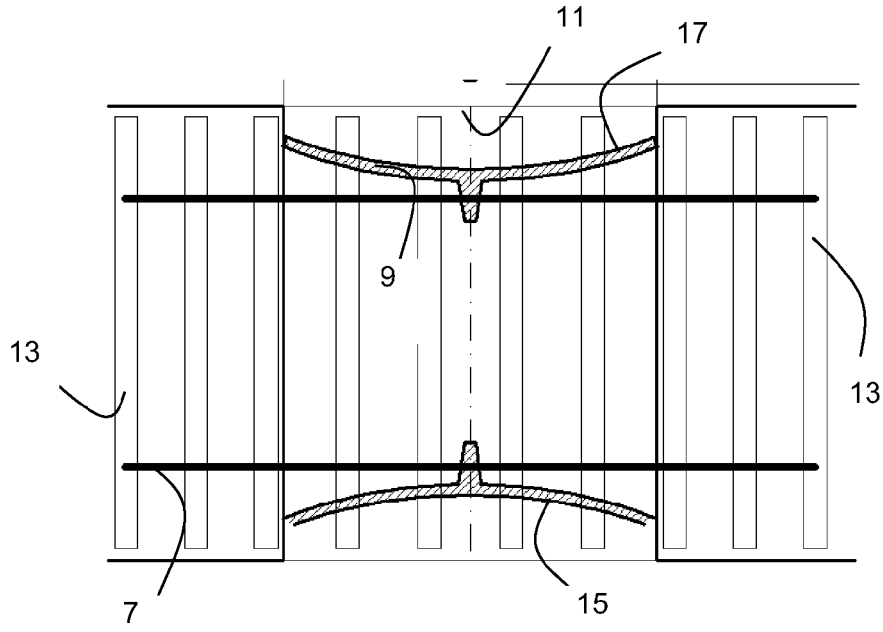
Figure 3C:
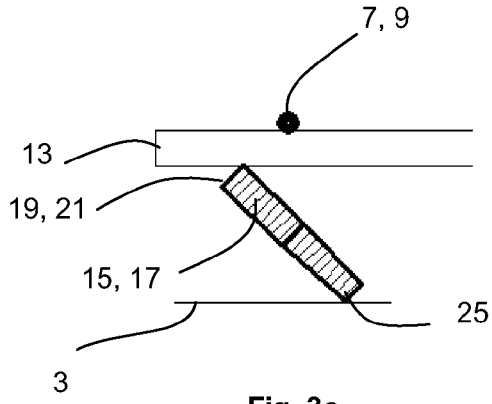
Figure 4A:
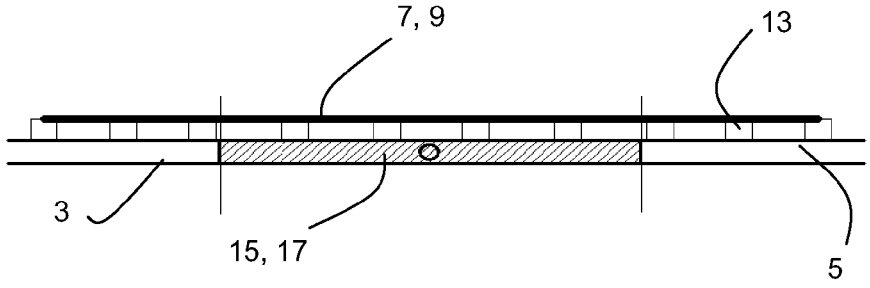
FIGS. 4*a*, 4*b* and 4*c* are schematic transverse side, plan and longitudinal end views of a rail support arrangement rail according to the invention in a third configuration.
Figure 4B:
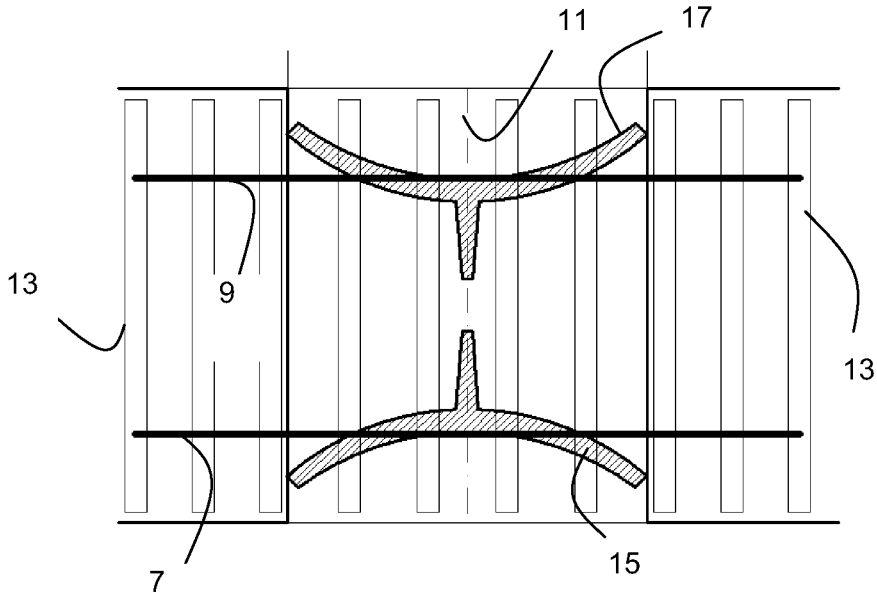
Figure 4C:
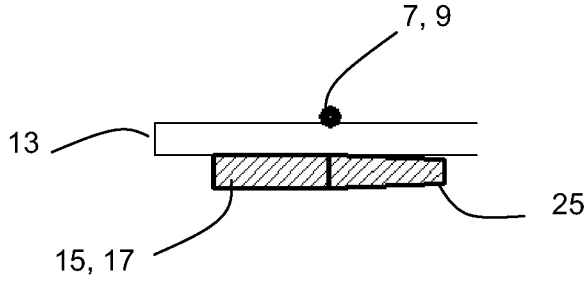

FIGS. 2*a* to 4*c* show an arrangement for supporting a rail according to the invention in three different configurations. In particular, FIGS. 2*a*, 3*a* and 4*a* are schematic transverse side views of the arrangement in the different configurations, FIGS. 2*b*, 3*b* and 4*b* schematic plan views of the arrangement in the different configurations and FIGS. 2*c*, 3*c* and 4*c* are schematic longitudinal end views of the arrangement in the different configurations.

As well as the components shown in and described with reference to FIGS. 1*a* and 1*b*, the arrangement according to the invention comprises a pair of longitudinally extending support beams 15, 17 which are each mounted in the hinge line 11 formed between the support elements 7, 9. The support beams 15, 17 each have an upper support surface 19, 21 which is curved along the length of the beams for supporting the curved portions of the rails 7, 9 via a plurality of transversely extending sleepers 13.

The support beams 15, 17 each have a downwardly extending limb 23 provided midway along the length of the beam and which extends in a perpendicular direction away from the upper support surface 19, 21. A distal end of the limb 23 is provided with a mounting surface 25 which is arranged for sliding along the transversely extending hinge line 11 between the support elements 3, 5.

The ends of the support beams 15, 17 are attached to the adjacent support elements 3, 5 such that the support beams 15, 17 are able to rotate relative to the support elements 3, 5 about longitudinal axes. Such rotation generally takes place as the angular misalignment between the support elements 3, 5 varies and as the mounting surface 25 of the downwardly extending limb 23 of the support beam 15, 17 slides along the transversely extending hinge line 11.

According to the invention, the rails 7, 9 having varying degrees of curvature in the vertical plane can be smoothly and continuously supported along their length by rotating the support beams 15, 17 about respective longitudinal axes. As the beams 15, 17 rotate, the degree of curvature of their support surfaces 19, 21, as viewed in the transverse direction (FIGS. 2*a*, 3*a* and 4*a*), changes.

FIGS. 2*a*, 2*b* and 2*c* show the arrangement in a first configuration. In this configuration, the angular misalignment between the support elements 3, 5 is at a maximum, as is the curvature of the rails 7, 9. The support beams 15, 17 are upright, that is to say the upper support surface is facing the vertical direction (see FIG. 2*b*). In this orientation of the support beams 15, 17, the support surfaces 19, 21 of the support beams 15, 17, when viewed in the transverse direction, have a maximum degree of curvature which matches the curvature of the rails 7, 9.

FIGS. 3*a*, 3*b* and 3*c* show the arrangement in a second configuration. In this configuration, the angular misalignment between the support elements 3, 5 and the curvature of the rails 7, 9 is less than that shown in FIGS. 2*a*, 2*b* and 2*c*. In this configuration, the support beams 15, 17 have rotated about respective longitudinal axes until the degree of curvature of the support surfaces 19, 21 of the support beams 15, 17, when viewed in the transverse direction, matches the curvature of the rails 7, 9.

FIGS. 4*a*, 4*b* and 4*c* show the arrangement in a third configuration. In this configuration, there is no angular misalignment between the support elements 3, 5 and the rails 7, 9 are therefore straight, that is to say without curvature. In this configuration, the support beams 15, 17 have further rotated about respective longitudinal axes until the support surfaces 19, 21 face away from each other in opposite transverse directions. In this orientation, the support surfaces 19, 21 of the support beams 15, 17 have no curvature when viewed in the transverse direction.

In each of the illustrated configurations, the support beams 15, 17 may be rotated into the respective orientation by the varying angular misalignment of the support elements 3, 5 causing bending displacement of the rails 7, 9. In particular, as the rails 7, 9 are displaced by bending, they bear against the upper support surfaces 19, 21 the support beams 15, 17, which rotate accordingly. In general, the curved length of the rails 7, 9 (which is fixed) corresponds substantially to the curved length of the support surfaces 19, 21 of the support beams 15, 17, as viewed in the transverse direction (which is able to vary).

According to the invention, when a railway vehicle passes over the rails 7, 9, deflection of the rails 7, 9 can be resisted or reduced by the support beams 15, 17. Deflection of the support beam 15, 17 may be prevented or restricted by a variety of spring and/or damper units coupled to the mounting surfaces of the support beams, suitable units being well known to those skilled in the art. The spring and/or damping units may serve to allow transverse sliding of the mounting surface 25 of the support beams 15, 17 when the curvature of the rails 7, 9 changes due to varying misalignment of the support elements 3, 5 but at the same time restrict sliding of the mounting surfaces when the rails 7, 9 are loaded by a moving railway vehicle. Such spring and/or damping units are, however, optional, there being sufficient inertia and/or friction in the arrangement to prevent excessive deflection of the rails under temporary moving loads.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devices without departing from the scope of the present invention as defined by the appended claims.

For example, the embodiment described above relates to rails which are configured to have varying curvature in the vertical plane. In other embodiments, the rails may be configured to have varying curvature in the horizontal plane. Such rails may, for example, be used for guiding or steering vehicles.

The embodiment described above comprises elongate support beams with mounting surfaces at the distal ends of downwardly extending limbs. In alternative embodiments the support beams may have different shapes, such as triangular.

The invention claimed is:

1. An arrangement for supporting a rail extending in the longitudinal direction and having curvature in at least one of a vertical and horizontal plane, the arrangement comprising:

at least one support beam extending in the longitudinal direction, the support beam having a support surface extending along its length, the support surface being curved along the length of the support beam; and at least one rail extending in the longitudinal direction and supported over the support surface of the at least one support beam, wherein each support beam is installed in a manner allowing rotation about the longitudinal direction such that the degree of curvature of the support surface, as viewed in a transverse or vertical direction, is able to vary, and wherein each said support beam in its installed position is permitted to slide in the transverse direction, thereby allowing the rotation of the support beam about the longitudinal direction.

2. An arrangement according to claim 1, for supporting a railway rail having curvature in the vertical plane, wherein the degree of curvature of the support surface of each support beam, as viewed in the transverse direction, is able to vary.

3. An arrangement according to claim 2, further comprising at least one transversely extending spacing element arranged between the at least one support beam and the at least one rail.

4. An arrangement according to claim 3, wherein the at least one transversely extending spacing element comprises a plurality of sleepers spaced apart in the longitudinal direction.

5. An arrangement according to claim 2, comprising two of the support beams spaced apart in the transverse direction and two of the rails spaced apart in the transverse direction which are in parallel arrangement and supported over the support surfaces of the support beams.

6. An arrangement according to claim 2, wherein each support beam has a mounting surface, facing away from the support surface, for mounting on a supporting structure.

7. An arrangement according to claim 6, wherein each support beam comprises a limb extending away from the support surface, the mounting surface being provided at a distal end of the limb.

8. An arrangement according to claim 6, wherein the mounting surface is arranged for mounting in a transversely extending channel formed by a V-shaped supporting structure.

9. An arrangement according to claim 6, wherein the mounting surface is arranged for mounting in a transversely extending hinge line of a pair of supporting elements.

10. An arrangement according to claim 6, wherein each support beam is installed such that the mounting surface is permitted to slide in the transverse direction, thereby allowing the rotation of the support beam about the longitudinal direction.

11. An arrangement according to claim 10, wherein portions of the support surface of each support beam are prevented from sliding in the transverse direction.

12. An arrangement according to claim 6, wherein each support beam is installed such that the support surface is permitted to slide in the transverse direction, thereby allowing the rotation of the support beam about the longitudinal direction.

13. An arrangement according to claim 12, wherein the mounting surface of each support beam is prevented from sliding in the transverse direction.

14. An arrangement according to claim 12, wherein the support surface of each support beam is further provided with curvature in the transverse or vertical direction.

15. An arrangement according to claim 12, further comprising at least one spring and/or damping means for resisting the rotation of each support beam as a point load, such as the wheel of a railway vehicle, is applied to each rail.

16. An arrangement according to claim 12, wherein each support beam is adapted to rotate such that the curvature of the support surface, as viewed in the transverse or vertical direction, is matched to the curvature of the rail.

17. An arrangement according to claim 12, wherein the curvature of the support surface of each support beam, as viewed in the transverse or vertical direction, defines a circular arc or a parabola.

18. An arrangement according to claim 12, wherein a range of rotation of each support beam about the longitudinal direction is less than or equal to 90 degrees.

19. An arrangement according to claim 12, wherein each support beam has a relatively small transverse thickness in a direction perpendicular to the curvature.

* * * * *